US005594294A

United States Patent [19]

Duffy et al.

[11] Patent Number: 5,594,294

[45] Date of Patent: Jan. 14, 1997

[54] LAMP ASSEMBLY WITH A RESILIENT RETAINING LAMP MOUNT STRUCTURE

[75] Inventors: Gerald E. Duffy, University Hts.; John J. Cowling, Streetsboro; D. Aaron Crites, Canal Fulton; Dale K. Mikol, Brecksville, all of Ohio

[73] Assignee: General Electric Company, Schenectady, N.Y.

[21] Appl. No.: 331,413

[22] Filed: Oct. 31, 1994

[51] Int. Cl.[6] ..... H01J 61/34

[52] U.S. Cl. ..... 313/25; 313/634; 313/239

[58] Field of Search ..... 313/25, 634, 239, 313/292

[56] References Cited

U.S. PATENT DOCUMENTS

| | | | |
|---|---|---|---|
| 4,602,185 | 7/1986 | Roiz et al. | 313/25 |
| 4,843,266 | 6/1989 | Szanto et al. | 313/25 |
| 5,270,608 | 12/1993 | Williamson et al. | 313/25 |
| 5,402,033 | 3/1995 | Van der Leeuw et al. | 313/25 |
| 5,440,196 | 8/1995 | Gleixner | 313/25 |
| 5,446,336 | 8/1995 | Gleixner et al. | 313/25 |

*Primary Examiner*—Sandra L. O'Shea
*Assistant Examiner*—Vip Patel
*Attorney, Agent, or Firm*—George E. Hawranko

[57] ABSTRACT

A lamp assembly having an improved mounting arrangement for a light source and shroud configuration provides for such improved mounting arrangement in a manner such that manufacturing of the lamp assembly is simplified and the light source is protected against vibration and shock forces during manufacture and operation. The light source includes an arc tube which is under pressure and which is disposed within a shroud member that is then mounted within an outer lamp envelope. Top and bottom support members made of an insulative material are disposed on opposite ends of the shroud member. One of the lead wires used to couple energy to the light source, extends through the shroud member and has an insulative sleeve disposed in surrounding relation to a portion thereof. As the one lead wire extends through a hole formed in the bottom support member, a resilient clip member is slid over the bottom portion of such lead wire. The resilient clip member contacts the bottom of such bottom support member and by virtue of a tapered neck portion, prevents movement of the support member and the shroud back down on the lead wire. The resilient clip member has a flat upper portion which is flexible so that vibration and shock forces that would otherwise be transmitted to the light source are transmitted instead through the lead wire that extends through the shroud member.

5 Claims, 1 Drawing Sheet

Fig. 1
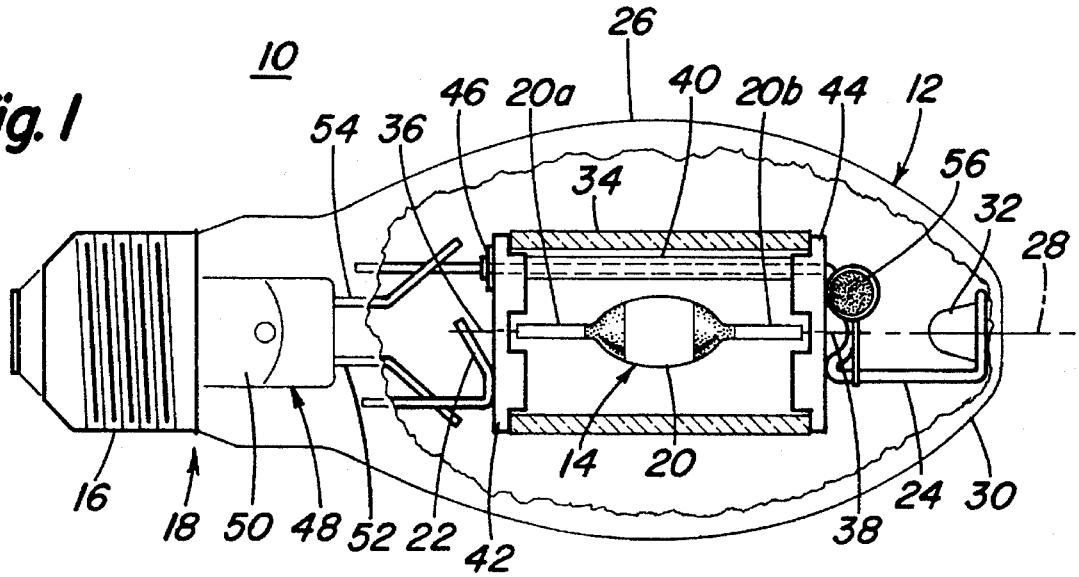
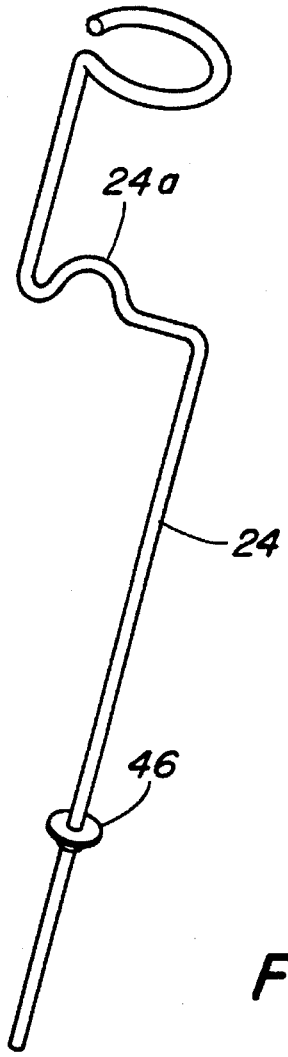
Fig. 2

LAMP ASSEMBLY WITH A RESILIENT RETAINING LAMP MOUNT STRUCTURE

FIELD OF THE INVENTION

This invention relates to a lamp assembly having a retaining lamp mount structure particularly suited for use with lamps having a shroud disposed in surrounding relation to an inner lamp envelope under pressure. More specifically, the present invention relates to such a lamp assembly as can include an economical and easily manufactured mounting arrangement that provides resiliency in the mount structure so as to insure that vibration or shock conditions occurring during manufacture or subsequent operation do not result in damage to the lamp.

BACKGROUND OF THE INVENTION

High intensity discharge (HID) lamps as are used in commercial and industrial installations because of their high luminous output as well as their long life characteristics utilize an arc tube having a fill contained therein excited to a discharge state upon introduction of the appropriate energy being supplied thereto. The fill contained within the arc tube is under pressure, typically on the order of about 10 atmospheres during operation (or 7600 torr). For safety purposes as well as for thermal management properties as is generally known in the lighting field, the arc tube will be surrounded by a shroud typically made of quartz and then such arc tube and shroud configuration is mounted within an outer lamp envelope which is evacuated and has a base portion attached thereto for supplying the appropriate energy. For an example of such a discharge lamp configuration having a shroud surrounding the arc tube, reference is made to U.S. Pat. No. 5,122,760 issued to Parrot et al. on Jun. 16, 1992.

With respect to the safety function of serving as a containment device in the event of a rupture of the arc tube, the shroud device has been proven to be effective to the extent of allowing the use of shrouded metal halide lamps in open fixtures, that is, fixtures that do not require an expensive cover plate. In utilizing the shrouded configuration, however, further consideration must be given to the problem of sodium loss from the fill as may occur as a result of a negative charge which is present on the arc tube walls and is caused by photoelectric emission from the electrified side rods used to support the arc tube and shroud within the outer lamp envelope. Various arrangements for solving this problem have been proposed and can be found in U.S. Pat. Nos. 4,963,790, 5,122,706, 5,136,204, 5,252,885, and, 5,270,608. Although the lamp mounting arrangements of these patents provide improvement over the then existing solutions to the support and sodium loss problem, such configurations suffer in terms of size due to the fact that all such arrangements utilize support members disposed outside of the shroud thereby increasing the need for space within the outer envelope. One solution to this size problem has been advanced by the teachings of U.S. patent application Ser. No. (Assignee Docket No. LD 10621) entitled "Lamp Assembly with Shroud Employing Insulator Support Stops" which is assigned to the same assignee as the present invention and is herein incorporated by reference.

It has been found that with the previous approaches to the problem of supporting the shroud and arc tube within the outer envelope, including the solution proposed in the above-referenced U.S. patent application Ser. No. (Assignee Docket No. LD 10621), there is a need for highly precise machining operations to be performed on the support members as well as the shroud so as to insure a sufficient fit between the various components that make up the arc tube, shroud and supporting component configuration. In fact, because of the tight fit necessary between the support members and the shroud itself, it has been found that a fit which is too tight will result in breakage of components during manufacture whereas a fit which is not tight enough can result in vibration of the component parts during operation of the lamp. In many cases, the cause of this problem is due to the inelastic nature of the respective component parts. In such an instance, the arc tube itself would serve as the tension member whereas the insulator support members would serve as compression members. The use of inelastic materials in both the tension members and the compression members results in a loose contact between all of the components. Such an inelastic structure is not robust to shock and may result in failure and further places stress on the arc tube seal structures. Therefore, it would be advantageous if a lamp assembly having a shroud disposed in surrounding relation to the arc tube could be provided that would have a support structure wherein components other than the arc tube would provide the resiliency needed to withstand the operating conditions of the lamp. It would be further advantageous to allow for a manufacturing process that was relaxed in terms of the precision of the machining requirements of the various components yet still achieving a product of the highest quality at an economical manufacturing cost of production.

SUMMARY OF THE INVENTION

The present invention provides for a lamp assembly having an arc tube, shroud arrangement that is supported within an outer lamp envelope and wherein such support arrangement provides for resiliency between the arc tube, shroud and necessary support components that prevents shock or other vibration forces from adversely affecting the arc tube. Moreover, such resilient support arrangement for the arc tube and shroud member configuration is provided in a manner that lends itself to high speed automated manufacturing techniques without the need for precision tooling or alignment operations during such high speed manufacturing.

In accordance with the principles of the present invention, there is provided a lamp assembly having a light source comprised of an arc tube which is under pressure and which is energizable to a light emitting state upon introduction of the appropriate energy across lead wires connected thereto. A cylindrically shaped shroud member made of a light transmissive material is disposed in surrounding relation to the arc tube. Top and bottom support members made of an insulative material, are disposed at opposite ends of the shroud member. Holes are formed in the support members to allow for passage of the lead wires therethrough. The arc tube and shroud member configuration are disposed in an outer lamp envelope which has a base member at the bottom portion for connection of energy from a power source. A stem support structure is mounted at the bottom portion of the outer lamp envelope and includes stem leads which connect the energy from the base member to the lead wires. The stem support structure along with the stem leads are effective for supporting the arc tube and shroud configuration within the outer lamp envelope. A resilient clip member is disposed on one of the lead wires at a position beneath the bottom support member associated with the shroud member. The resilient clip member contacts the bottom support member and prevents movement of the shroud member along the one lead wire. The resilient clip member is constructed so as to provide flexibility to the overall arc tube, shroud member configuration and to insure that shock and vibration forces as can occur during manufacture or operation of the lamp assembly are transmitted away from the arc tube.

BRIEF DESCRIPTION OF THE DRAWINGS

In the following detailed description, reference will be made to the attached drawings in which:

FIG. 1 is an elevational view in section of a lamp assembly constructed in accordance with the present invention.

FIG. 2 is an elevational view of a lead wire portion of the lamp assembly having a clip member mounted thereon in accordance with the present invention.

DETAILED DESCRIPTION OF THE INVENTION

As seen in FIG. 1, a lamp assembly 10 constructed in accordance with the present invention, includes an outer lamp envelope 12 having a light source 14 disposed therein. A base member 16 is disposed on a tapered or neck region 18 formed at one end of the lamp envelope 12, the base member 18 allowing connection to an appropriate power source (not shown). The light source 14 is a metal halide arc discharge type of light source and includes an arc tube 20 containing therein, a fill which is under pressure. Such a light source is widely available in the marketplace in various power ratings; for a description of the operation of such a light source, reference is hereby made to U.S. Pat. No. 4,161,672 which is assigned to the same assignee as the present invention and which is herein incorporated by reference. Of course, it is to be understood that other light sources can be utilized in place of a metal halide light source, for instance, a tungsten halogen incandescent light source or other lamp which is advantageously operated with a shroud member, can be utilized as well. The arc tube 20 is generally ellipsoidal in shape with sealed ends 20*a* and 20*b* extending therefrom and through which the connection of electrodes and electrode leads (not shown) to lead wires 22 and 24 is accomplished.

The outer lamp envelope 12 has a main portion 26 elongated about a central axis. The neck region 18 extends from the main portion 26 and can include a two tier tapered configuration as shown in FIG. 1. The main portion 26 of outer lamp envelope 12 can be cylindrical in shape and can terminate at a rounded top region 30. The top region 30 has a dimple 32 formed internally thereof, the dimple serving as a mounting point for one end of one of the lead wires 24. The outer lamp envelope 12 is typically formed of a blow molded hard glass such as borosilicate.

Disposed within the outer lamp envelope 12 in surrounding relation to the arc tube 20, is a shroud member 34 which is cylindrically shaped and has open ends formed at opposite ends thereof thus forming a cavity or interior space therebetween. Preferably, the shroud member 34 is made of a light transmissive and heat-resistant material such as quartz or glass. The shroud member 34 is supported within the outer lamp envelope 12 in a generally coaxial manner relative to the arc tube 20. The shroud member 34 preferably has a length greater than the distance between the outer ends 20*a* and 20*b* of the sealed region of the arc tube 20 but less than the distance between the outer ends of the arc tube electrode leads 36, 38. The shroud member 34 typically has a wall thickness of about 2.5 mm, and preferably is between about 1.5 mm and about 2.5 mm. The outer diameter of the shroud member is selected so as to be at a maximum dimension that can fit within the inner diameter of the neck region of the lamp outer envelope 12. In this manner, the greatest distance between the outer dimension of the arc tube 20 and the inner dimension of the shroud member 34 is achieved; this increased distance results in improved containment properties of the shroud member 34 in the event of a rupture of the arc tube 20 since at the greater distance, fragments from the arc tube 20 would have less velocity and hence, less energy.

Further contributing to the ability to utilize a shroud member 34 having an outer diameter that is maximized is the fact that the return lead wire 24 extends through and not around the shroud member 34 as is prevalent in the prior art; when the return lead wire 24 is disposed outside of the shroud member 34, the outer diameter of the shroud member must be reduced or the neck region of the lamp envelope must be enlarged and a larger base member installed, such requirements serving to limit the applicability of the lamp in terms of the variety of fixture environments in which it could be utilized. For the lamp assembly 10 shown in FIG. 1, an insulative sleeve member 40 is disposed around that portion of the return lead wire 24 that extends through the shroud member 34. Because of these containment properties of the lamp assembly 10 of FIG. 1 and the use of the shroud member 34 having a maximized outer diameter, it is possible to utilize the subject lamp assembly 10 in a variety of different light fixtures. More particularly, the configuration of shown in FIG. 1 allows for applications for which there is no cover member over the opening of the fixture or where there is a requirement that the screw base be of a conventional size similar to a standard lamp and not the larger mogul screw base as would be required for a lamp having the larger neck region to accommodate the larger diameter shroud member.

In order to support the arc tube 20 and shroud member 34 within the outer lamp envelope 12, upper and lower insulated support stop members 42, 44 are provided. The insulated support members 42, 44 are preferably made of ceramic and are shaped in an essentially rectangular form so as to leave part of the openings at either end of the shroud member 34 open. For a more detailed discussion of the support members 42, 44, reference is hereby made to the previously noted copending patent application Ser. No. (Assignee Docket No. LD 10621). The arc tube 20 and shroud member 34 along with the support members 42, 44 are then supported as well by the lead wires 22 and 24. For lead wire 22, it can be seen that the J-shaped configuration of such lead wire 22, serves to contact the bottom portion of the support member 42 and thereby provide some measure of support for the overall structure of the arc tube 20, shroud 34 and support members 42, 44. Similarly, the other lead wire 24 which extends through the shroud member 34 provides a further measure of support to the arc tube 20, shroud 34 and support members 42, 44.

A resilient clip member 46 is inserted onto the lead wire 24 during lamp manufacture and is pushed along lead wire 24 until contact is made with the bottom support member 42. Resilient clip member 46 is generally circular in shape and has an upper portion of a generally wider diameter than a lower tapered portion. The lower tapered portion of the resilient clip member 46 serves to prevent movement of the clip member 46 back down on the lead wire 24 once it has been inserted into the proper position. As can be seen in FIG. 1, the resilient clip member 46 works in cooperation with the curved upper portion 24*a* of the lead wire 24 to hold the arc tube 20, shroud member 34 and support members 42, 44 in place.

As can be seen more clearly in FIG. 2, the upper portion of the resilient clip member 46 is essentially flat and by such a construction, it can be appreciated that the resilient clip member 46 provides a measure of elasticity to the supporting arrangement for the arc tube 20, shroud member 34 and support members 42, 44. In other words, by the flexible nature of the upper flat portion of the resilient clip member 46, any shock or vibration forces which would be directed to the light source and shroud configuration 14, 34 can be directed away from the arc tube 20. Absent the provision of the resilient clip member 46, the shroud member 34 and the support members 42, 44 would be pinned between the lead wires 22 and 24 so as to serve as compression members with the arc tube 20 disposed therebetween serving as the tension member. The use of inelastic materials in both the tension member (i.e. arc tube) and the compression members (i.e. shroud and supports) results in a loose contact between all of the members thereby allowing that components may slip relative to one another and thus requiring significant precision efforts in aligning the various components during manufacture. Additionally, the use of such inelastic materials for the tension and compression members puts undue strain on the arc tube and may therefore result in early failure of such arc tube 20.

By use of the resilient clip member 46 over the lead wire 24, the lead wire 24 becomes the tension member whereas the support members 42, 44 and the shroud member 34 maintain their role as the compression members. In this manner, the resilient clip member 46 acts as a spring to maintain close contact between the inelastic members and thus remove tension from the more sensitive arc tube 20.

Referring again to FIG. 1, it can be seen that the arc tube 20, shroud member 34 and support members 42, 44 configuration is mounted on a stem support structure shown generally as reference number 48. Stem support structure 48 is of a conventional configuration and includes a glass base portion 50 and stem leads 52, 54 on which are mounted the lead wires 22, 24. As further seen in FIG. 1 a getter device 56 made of a barium peroxide material is mounted on the upper curved portion of lead wire 24. As is well known in the lighting art, getters are used in lamps where an evacuated or inert gas environment within the outer lamp envelope is provided.

Although the hereinabove described embodiment constitutes the preferred embodiment of the invention, it should be understood that modifications can be made thereto without departing from the scope of the invention as set forth in the appended claims.

What is claimed is:

1. A lamp assembly comprising:

a light source having an arc tube associated therewith, said arc tube being under pressure and being excitable to a light emitting state upon energy being applied thereto;

lead wires connected to said arc tube and effective so as to allow such energy to be coupled to said light source;

a cylindrically shaped shroud member made of a light transmissive material and.being disposed in surrounding relation to said arc tube;

a top and a bottom support member disposed respectively on opposite ends of said shroud member, said top and bottom support members being made of an insulative material;

an outer envelope surrounding said light source, shroud member and said support members, said outer envelope having a screw base member disposed on a bottom end, said base member being receptive of such energy;

a stem support structure mounted within said bottom end of said lamp envelope, said stem support structure having stem leads extending therefrom, said stem leads being connected to said lead wires so as to couple such energy to said light source and further being effective so as to support said light source and shroud within said lamp envelope;

a resilient clip member disposed on one of said lead wires at a position beneath said bottom support member, said resilient clip member contacting said bottom support member and preventing movement of said bottom support member and said shroud member along said one lead wire, said resilient clip member being flexible so that vibration and shock forces are transmitted away from said arc tube thereby;

wherein said resilient clip member has a neck portion which, when slid over said one lead wire in a first. direction, prevents movement of said resilient clip member back on said lead wire in an opposite direction, said resilient clip member further having an essentially flat upper portion which contacts a bottom region of said bottom support member, said flat upper portion being resilient such that said one lead wire on which said resilient clip member is mounted becomes a tension member interposed between compression members which include said support members and said shroud member; and, wherein said one lead wire acting as said tension member extends through said shroud member for a portion thereof.

2. A lamp assembly as set forth in claim 1 wherein one of said lead wires is J-shaped and said resilient clip member is disposed on the other of said lead wires.

3. A lamp assembly as set forth in claim 1 wherein said portion of said one lead wire extending through said shroud member has an insulative sleeve member disposed in surrounding relation thereto.

4. A lamp assembly as set forth in claim 1 wherein said light source is a metal halide light source having a fill contained within said arc tube.

5. A lamp assembly comprising:

a light source having an arc tube associated therewith, said arc tube being under pressure and being excitable to a light emitting state upon energy being applied thereto;

lead wires connected to said arc tube and effective so as to allow such energy to be coupled to said light source;

a cylindrically shaped shroud member made of a light transmissive material and being disposed in surrounding relation to said arc tube;

at least one support member disposed on at least one of a first and a second end of said shroud member;

an outer envelope surrounding said light source, shroud member and said support members, said outer envelope having a screw base member disposed thereon;

a stem support structure mounted within said bottom end of said lamp envelope, said stem support structure having stem leads extending therefrom, said stem leads being connected to said lead wires so as to couple such energy to said light source and further being effective so as to support said light source and shroud within said lamp envelope;

a resilient clip member disposed on one of said lead wires at a position adjacent one of said at least one support members, said resilient clip member contacting said one of said at least one support member and being effective so as to prevent movement of said shroud member along said one lead wire;

said resilient clip member having a flat portion which contacts said one of said at least one support members, said flat portion being resilient such that said one lead wire on which said resilient clip member is mounted becomes a tension member interposed between compression members which include said at least one support member and said shroud member; and, wherein said one lead wire on which said resilient clip member is mounted extends through said shroud member for a portion of the length thereof.

* * * * *